United States Patent [19]

Roudybush et al.

[11] 4,331,360

[45] May 25, 1982

[54] RESILIENT ACCESSORY FOR SEAT OR THE LIKE

[75] Inventors: Gerald L. Roudybush, Butler; Richard A. Wilson, Pittsburgh, both of Pa.

[73] Assignee: Magee Plastics Company, San Mateo, Calif.

[21] Appl. No.: 200,813

[22] Filed: Oct. 27, 1980

[51] Int. Cl.[3] ..... A47C 1/02; A47C 7/54

[52] U.S. Cl. ..... 297/422; 108/901; 248/118; 297/DIG. 2; 297/411

[58] Field of Search ..... 248/118; 297/DIG. 2, 297/219, 391, 411, 412, 422; 108/901

[56] References Cited

U.S. PATENT DOCUMENTS

| | | | |
|---|---|---|---|
| 2,318,841 | 5/1943 | Dodge | 248/118 |
| 2,690,212 | 9/1954 | Jakeway | 297/416 |
| 2,802,519 | 8/1957 | Jeckell et al. | 297/412 |
| 3,300,250 | 1/1967 | Dollgener et al. | 248/118 X |
| 3,664,271 | 5/1972 | Wolder et al. | 108/901 |
| 3,717,396 | 2/1973 | Dupree | 108/901 |
| 4,015,545 | 4/1977 | Kurokawa | 108/901 X |
| 4,019,779 | 4/1977 | Hogan | 297/411 |
| 4,088,367 | 5/1978 | Atkinson | 297/DIG. 2 |
| 4,099,780 | 7/1978 | Schmidhuber | 297/411 |
| 4,189,125 | 2/1980 | Little | 108/901 |

FOREIGN PATENT DOCUMENTS

| | | | |
|---|---|---|---|
| 2147216 | 4/1973 | Fed. Rep. of Germany | 297/DIG. 2 |
| 1577231 | 10/1980 | United Kingdom | 297/DIG. 2 |

*Primary Examiner*—James T. McCall

[57] ABSTRACT

A resilient accessory adapted for a number of different uses including a resilient cap for the top of an armrest of an airplane passenger seat. The accessory includes a hollow, resilient, first member having an outer wall and a pair of sides integral with the outer wall, and a second rigid, plate-like member secured to the first member in closing relationship to an open extremity of the first member opposite to the outer wall thereof. The first and second members are interconnected by posts integral with the first member and extending through holes in the second members, the outer ends of the posts having heads which retain the second member on the first member. A number of stops adjacent to the posts are integral with the first member and engage the inner surface of the second member, whereby the heads and the stops hold the second member in a fixed position relative to the first member.

10 Claims, 13 Drawing Figures

RESILIENT ACCESSORY FOR SEAT OR THE LIKE

The invention relates to improvements in resilient accessories for use on seats or near seats, especially passenger seats in airplanes and, more particularly, to an improved resilient accessory which can be subjected to bending forces without exceeding the elastic limit of the member.

SUMMARY OF THE INVENTION

The present invention satisfies the aforesaid need by providing for improvements in chairs or seats of various kinds which are used in environments requiring a lightweight construction without sacrificing strength and aesthetic appearance. The teachings of the present invention, while suited for a wide variety of uses, are especially suitable for use in various parts of airplane passenger seats.

To this end, the present invention includes a two-piece accessory comprised for a first, resilient member molded from a suitable material and a second, relatively thin, rigid member which is secured to the first member by posts integral with the first member passing through holes in the second member, the posts having heads which hold the second member against stops integral with the first member.

In one embodiment, the stops are defined by spaced, thin walled partitions spanning the distance between the sides of the first member, and the outer edge margins of the partitions normally engage or are in proximity to the adjacent flat surface of the second member. Thus, bending forces can be safely exerted on the first member since these forces will be resisted by the engagement of the partitions with the second member to assure that the first member will yield without exceeding its elastic limit or otherwise causing damage to it. This feature provides for the comfort of a passenger using the seat having the accessory yet the accessory can be sufficiently attractive to provide a distinctive design and a finished appearance for the seat. In another embodiment, the stops project inwardly from the sides of the first member but do not span the distance between such sides.

For a passenger seat for an airplane, the teachings of the present invention can be used with the cap for an armrest of the seat, the seat cushion for the seat, the back of the seat, the aisle side portion of the seat, and the bottom of a tray table which is ahead of the passenger seat and on the back of the next forward passenger seat. While the teachings of the invention will be hereinafter described with respect to a cap for an armrest of a passenger seat for an airplane, it is not to be limited to such an application but is suitable for other uses as well.

The primary object of this invention is to provide an improved resilient accessory which is adapted for use in an environment where bending and other forces are ofentimes exerted on the accessory and the accessory is constructed to permit it to yield to a limited degree yet the accessory is lightweight in construction and has an aesthetic appearance all without sacrificing strength and durability.

Other objects of this invention will become apparent as the following specification progresses, reference being had to the accompanying drawings for an illustration of the invention.

IN THE DRAWINGS

While the teachings of the present invention can be suitable for use a number of different applications one application in which the invention can be put is for providing a cap for an armrest of a chair, such as a passenger seat of an airplane. Such a cap will be hereinafter described with respect to two different embodiments shown in FIGS. 1–7 and FIGS. 8–13; however, it is to be emphasized that the invention is broader in scope than the limitations recited with respect to the description which follows.

Armrest cap 10 of the first embodiment includes an upper hollow member 12 of resilient material and a lower member 14 which is generally rigid and is in the form of a plate. Both members 12 and 14 are of lightweight construction and are selected from materials which minimize the weight of the cap yet provided a construction which is strong and durable. For this purpose, member 12 is molded from polyurethane or other suitable plastic, and member 14 is formed from aluminum.

Figure 1:
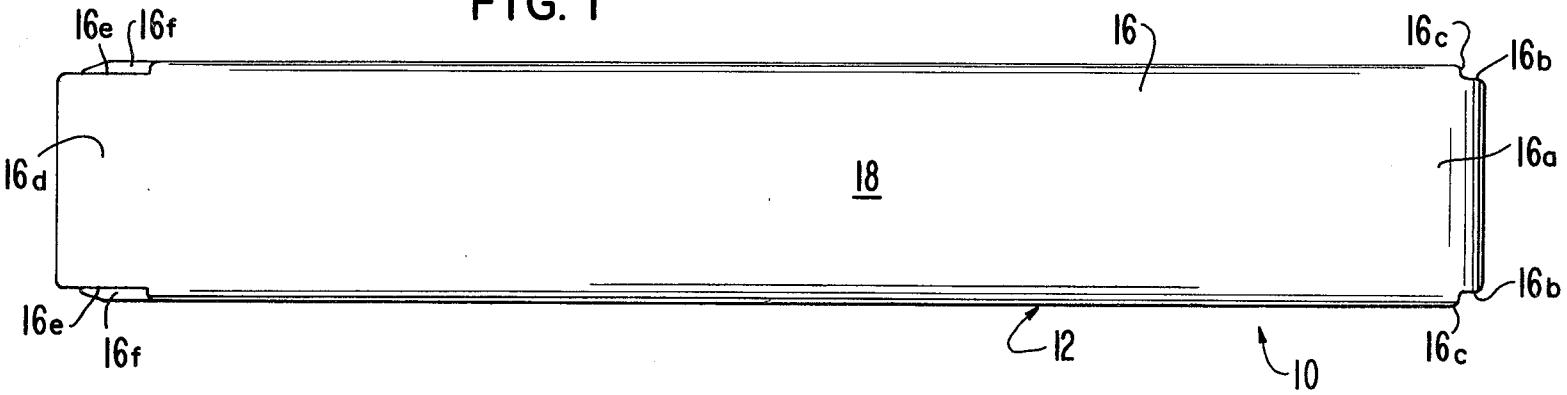
FIG. 1 is a top plan view of one embodiment of the present invention, specifically, a cap for the armrest of a chair, such as a passenger seat of an airplane.
Figure 3:
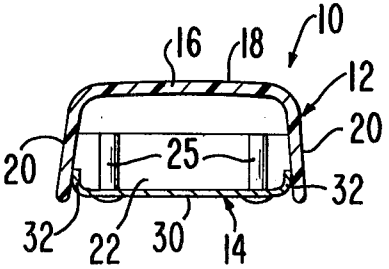
FIG. 3 is a cross-sectional view taken along line 3—3 of FIG. 2.
Figure 6:
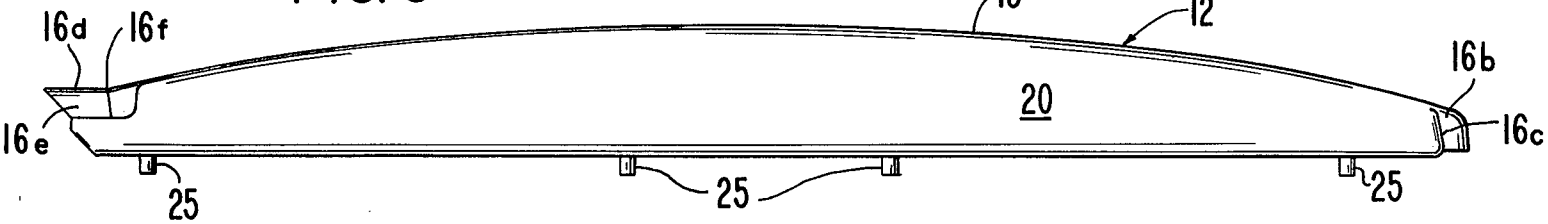
FIG. 6 is a side elevational view of the upper member with the lower member removed.
Figure 7:
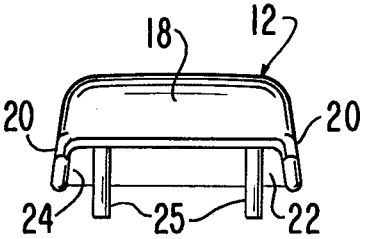
FIG. 7 is an end elevational view of the upper member with the lower member removed.

Member 12 has a top wall 16 provided with a generally convex upper surface 18 and a pair of sides 20, top wall 16 and sides 20 being integral with each other and sides 20 being slightly angled as shown in FIG. 3. The outer surfaces of the top wall and the sides are generally smooth and the junctions between the top wall and the sides is slightly curved as shown in FIGS. 3 and 7 so that there is a smooth merger with no sharp edges at these two junctions. One end **16*a* of top wall 16 extends downwardly and has a pair of recessed margins 16*b* (FIG. 1) to present a pair of inclined end faces 16*c* (FIGS. 1 and 6). These end faces 16*c* are adapted to be engaged by a molding or other hold-down means on the armrest with which cap 10** is to be used. Such molding thereby provides for releasably securing the adjacent end of the cap to the armrest.

Figure 2:
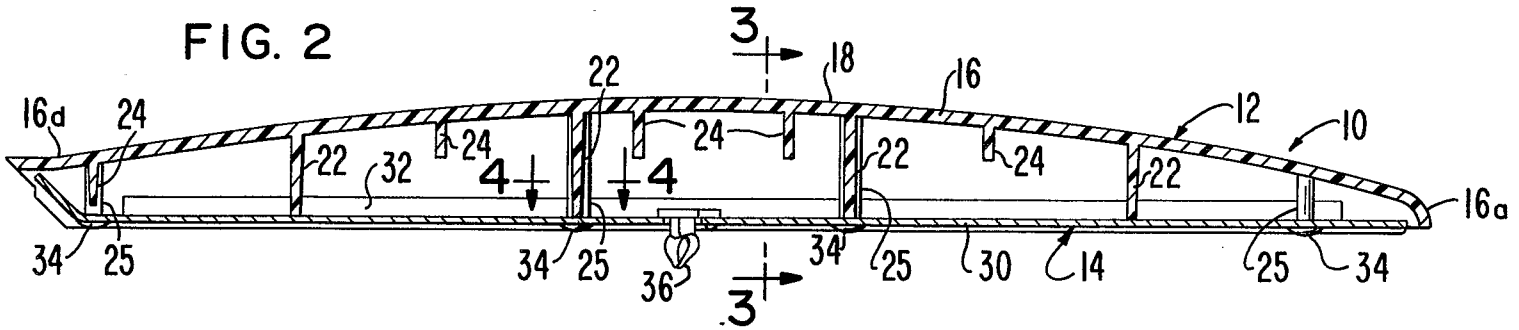
FIG. 2 is a vertical section through the armrest cap of FIG. 1 showing the upper molded resilient member and the lower rigid mounting member with the members coupled together.
Figure 4:
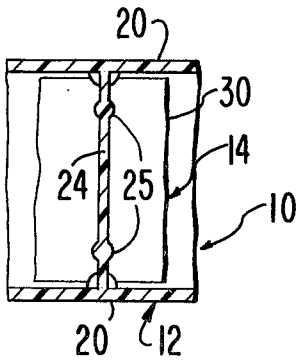
FIG. 4 is a cross-sectional view taken along line 4—4 of FIG. 2.

The opposite end of the top wall 16 flattens out to present a flat upper surface 16*d* (FIGS. 1, 2 and 6). This end also has recesses 16*e* on opposed sides of surface 16*d* and these recesses form generally flat upwardly facing sides surfaces 16*f* (FIGS. 1 and 6) which are also adapted to be engaged by a molding or hold-down means carried by the armrest of the chair with which cap 10 is to be used. This molding operates to releasably secure the opposite end of cap 10 to the armrest.

Figure 5:
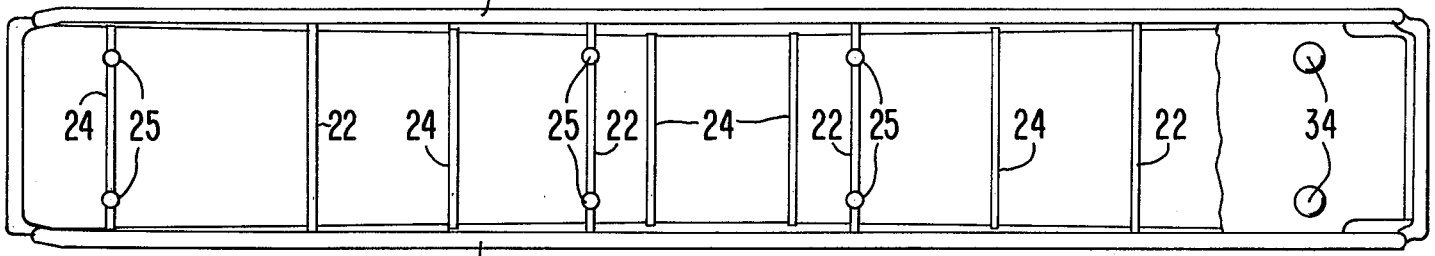
FIG. 5 is a bottom plan view of the upper member of the cap with the lower member removed.

Upper member 12 has a number of stops defined by relatively thin, spaced partitions or walls integral with the inner surfaces to top wall 16 and sides 20. For purposes of illustrations, there are four relatively long partitions 22 and five relatively short partitions 24 as shown in FIG. 2. Partitions 22 and 24 span the distance between sides 20 as shown in FIG. 5. The lower edge margins of partitions 22 terminate near the plane of the lower edges of sides 20. Partitions 24 terminate at locations spaced above the lower edge margins of partitions 22 as shown in FIG. 2.

Upper member 12 has a number of posts 25 which extend outwardly through the open bottom of member 12 as shown in FIG. 6 before the posts are coupled with lower member 14 as hereinafter described. For purposes of illustration, posts 25 are shown in pairs, with one pair being integral with the partition 24 at the left end of accessory 10 when viewing FIGS. 2 and 5, two pairs of posts 25 being integral with partitions 22 near the center of upper member 12, and one pair of posts being integral with the inner surface of top wall 16 near the right end of accessory 10 when viewing FIG. 2.

Typical dimensions for top wall 16 are as follows: The straight line distance between the ends of top wall 16 is 11.656 inches. The thickness of top wall 16 is 0.125 inches, the thickness of each of partitions 22 and 24 is 0.045 inches, and the width of top wall 16 is 1.80 inches. The diamenter of posts 25 is 0.093 inches.

Lower member 14 includes a flat, rigid, plate-like body 30 having a pair of side flanges 32 as shown in FIGS. 2 and 3. Body 30 is preferably formed of aluminum. Flanges 32 extend throughout a major portion of the length of body 30 but terminate near the left-hand partition 24 (FIG. 2*a*) and near the posts 25 at the right hand side of FIG. 2. Body 30 has holes therethrough for receiving the lower ends of posts 25, and the outer ends of posts are flattened over the holes by the application of heat to the lower ends of the posts to form rivet-like heads 34 (FIGS. 2 and 5) which permanently connect upper and lower members 12 and 14 and hold member 14 against the stops defined by the partitions. Body 30 has a clip 36 secured thereto and extending downwardly therefrom as shown in FIG. 3 so that the clip can extend into a hole in the armrest (not shown) with which cap 10 is to be associated to assist in releasably connecting the cap to the armrest.

When members 12 and 14 are connected together in the manner shown in FIG. 2, cap 10 is ready to be installed on an armrest. To this end, cap 10 is placed on the armrest so that the ends of upper part 16 are in positions to be engaged by the end moldings ordinarily carried by the armrest. When the moldings engage and thereby clamp or hold down the ends of the cap, the cap is ready to be used.

During use, lower end margin of partitions 22 essentially engage the upper surface of body 30 of lower member 14. Thus, any downward forces exerted on top wall 16 vertically aligned with a partition 22 will be resisted by the partition because it engages lower member 14. Also, any force exerted downwardly on top wall 16 at a location between a pair of adjacent partitions 22 will also be resisted by these two partitions and by the restoring force inherent in the resilience of the material with which upper part 12 is made. If the force is so great that it causes top wall 16 to yield considerably, top wall 16 can yield sufficiently until one of the shorter partition 24 engaged the upper surface of body 30 of member 14. This will assure that, even though the force exerted on top wall 16 is excessive, the top wall itself will never "bottom out" on upper member 14 because one or more of the partitions will engage member 14 before the elastic limit of upper member 12 is exceeded.

By placing the partitions at spaced locations along the length of upper part 16, the durability of the upper part is assured regardless of where a force is exerted on top wall 16, and accessory 10 will have, as a result, a relatively long operating life, notwithstanding the fact that it is light in weight, has an aesthetic appearance, and can readily be mounted in place on the armrest of a seat.

In the second embodiment of the present invention, the arm rest cap is defined by an upper, resilient member 112 and a lower, generally rigid member 114. Members 112 and 114 are typically of the same materials as members 12 and 14 of cap 10.

Figure 8:
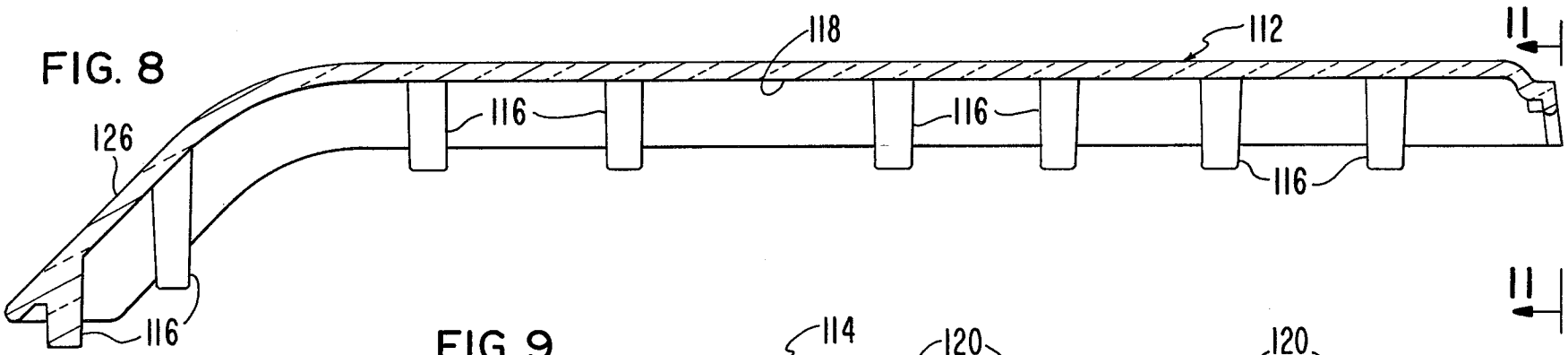
FIG. 8 is a vertical section through the upper molded resilient member of a second embodiment of this invention.
Figure 9:
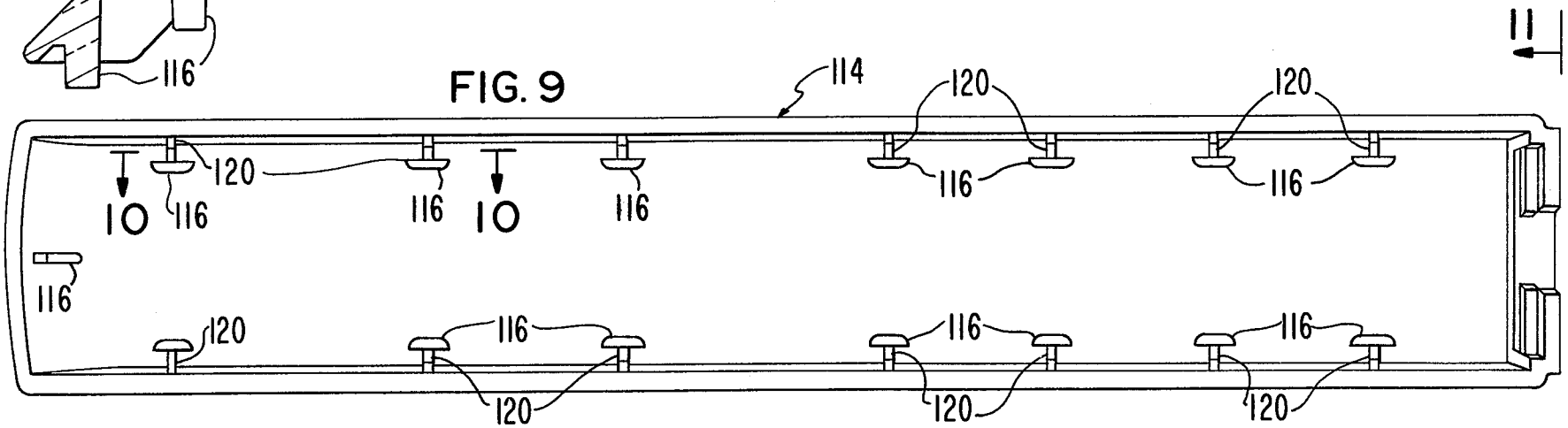
FIG. 9 is a bottom plan view of the member of FIG. 8.
Figure 11:
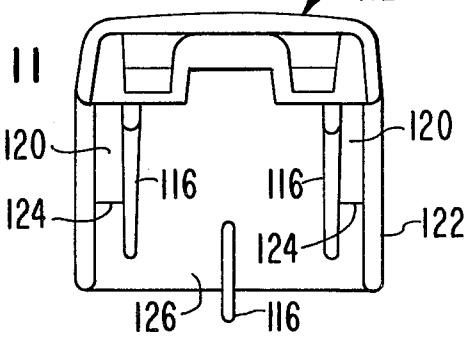
FIG. 11 is an end elevational view looking in the direction of line 11—11 of FIG. 8.
Figure 10:
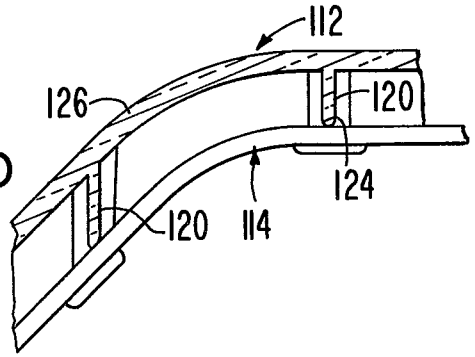
FIG. 10 is a fragmentary, cross-sectional view taken along line 10—10 of FIG. 9.
Figure 12:
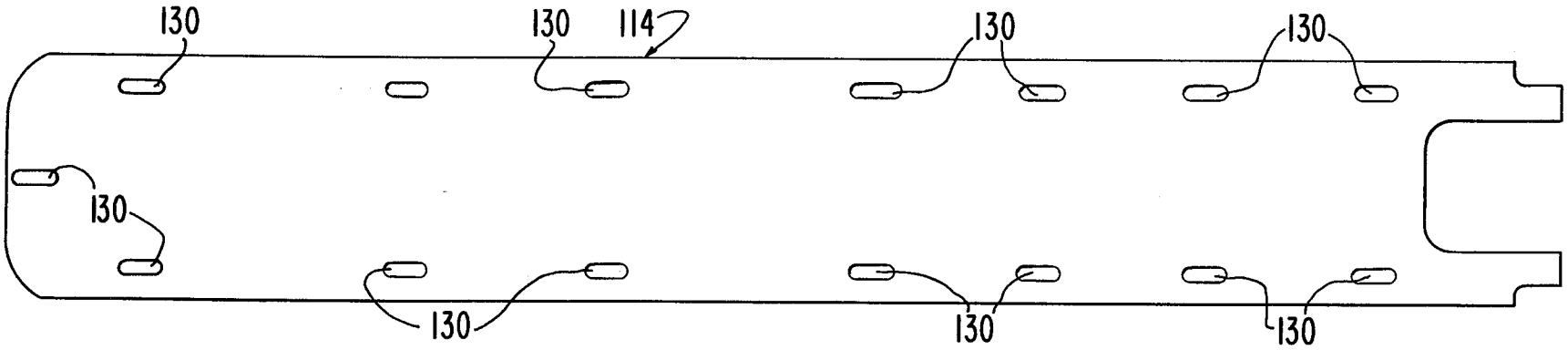
FIG. 12 is a plan view of the rigid mounting member for the resilient member of FIGS. 8 and 9.

Member 112 has a number of posts 116 integral therewith and extending downwardly from the inner surface 118 of the top portion of 112. Posts 116 are flattened in the direction of the longitudinal axis of member 112 as shown in FIG. 8 and are relatively thin when looking transversely thereof as shown in FIG. 11. A number of stops 120 are integral with respective posts 116 as shown in FIGS. 10 and 11. These stops are webs integral with the sides 122 of member 112 and also integral with the adjacent posts 116. The posts are longer in length than stops 120 so that the stops present lower edges 124 which terminate short of the lower ends of posts 116.

The posts extend downwardly through the open lower end of member 112 as shown in FIG. 8. One end 126 of member 112 is curved as shown in FIG. 8. This end can either be the front end of the cap or the rear end thereof.

Figure 13:
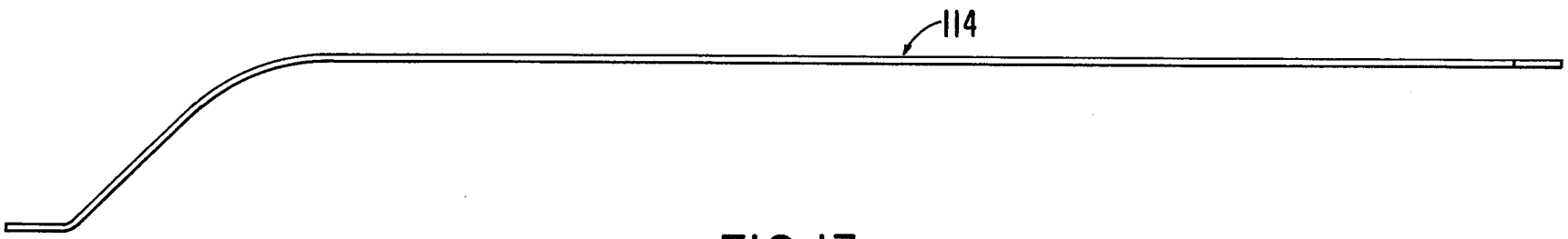
FIG. 13 is a side elevational view of the rigid member of FIG. 12.

Member 114 has a shape of the type shown in FIG. 13. Member 114 has a number of slots 130 therethrough for receiving the lower ends of posts 116 when member 114 is in the operative position shown in FIG. 10. There is a slot 130 for each post 116, respectively. When member 114 is mounted on the posts, the upper surface of member 114 engages the lower edges 124 of stops 120 to limit the inward travel of member 114 within member 112. Then, the lower ends of post 116 are heated to form heads similar to heads 34 which permanently attach members 112 and 114 together.

The armrest cap formed by members 112 and 114 is placed on an arm rest in the manner described above with respect to cap 10. When a downward force is applied to the upper surface of member 112, the fact that stops 120 are integral with posts 116 and sides 122 assures that sides 122 will not bow outwardly due to the force. Thus, if construction tends to resist the downward force applied to the upper surface of member 112. This assures that the material of 112 will not exceed it elastic limit so that the cap formed by the member will have a long useful life.

Other embodiments using the teachings of the present invention can include a seat cushion for a chair or other support. The seat can be of any desired shape, such as square, rectangular, circular or hexagonal. In all cases, the seat will include an upper resilient member provided with spaced stops and a lower member or rigid material, such as aluminum. The lower edges of certain of the stops will engage the upper surface of the lower member and the locations of the stops can be selected so that the seat provides maximum comfort to the user notwithstanding the load bearing capability of the stops. In any cases, the upper and lower members are of lightweight construction and the accessory formed by the members has an attractive appearance and can readily be mounted in an operative position.

We claim:

1. A resilient support comprising: a first member of resilient material, said first member having a wall and a pair of spaced sides integral with the wall, the outer margins of the sides defining an opening in the first member opposite to the wall, there being a number of spaced stops on the first member and extending toward the opening; a second, generally rigid member between the sides of the first member; and post means carried by the first member and extending through the second member for interconnecting the members, the outer edge margins of the stops being in sufficiently close proximity to the inner surface of the second member to engage the inner surface of the second member in load bearing relationship with respect thereto when a force is exerted on the first member.

2. A support as set forth in claim 1, wherein said mounting means includes a number of posts integral with the first member, the second member having a number of holes for receiving respective posts, the outer ends of the posts having respective heads with transverse dimensions larger than the holes through the second member.

3. A support as set forth in claim 2, wherein certain of the posts are integral with respective stops and extend outwardly therefrom.

4. A support as set forth in claim 1, wherein the stops define partitions integral with the inner surfaces of the wall and spanning the distance between the sides of the first member.

5. A support as set forth in claim 1, wherein the stops are integral with the inner surfaces of the sides of the first member and project into the first member and terminate in spaced relationship to each other.

6. A support as set forth in claim 1, wherein the outer surface of the first member is substantially convex.

7. A support as set forth in claim 1, wherein the stops define flat partitions, the inner surface of the second member being substantially flat and generally perpendicular to the planes of the partitions.

8. A support as set forth in claim 1, wherein included a second set of stops integral with the first member and extending toward said second member, the outer edge margins of the second set of stops being spaced from the opening.

9. A support as set forth in claim 1, where in the first member is formed of polyurethane and the second member is formed of aluminum.

10. A support as set forth in claim 1, wherein the second member has an outer, generally flat surface substantially in the plane of the opening.

* * * * *